US005159797A

United States Patent [19]

Herzog

[11] Patent Number: 5,159,797

[45] Date of Patent: Nov. 3, 1992

[54] BALL CAP ORIENTER

[76] Inventor: Kenneth J. Herzog, 135 Industrial Blvd., Riverhead, N.Y. 11901

[21] Appl. No.: 655,741

[22] Filed: Feb. 15, 1991

[51] Int. Cl.[5] ..... B65B 7/28

[52] U.S. Cl. ..... 53/312; 53/317; 53/367; 193/47

[58] Field of Search ..... 53/310, 311, 312, 317, 53/367; 193/47; 198/417

[56] References Cited

U.S. PATENT DOCUMENTS

| | | | |
|---|---|---|---|
| 2,672,269 | 3/1954 | Resina | 53/367 |
| 2,826,885 | 3/1958 | Henderson et al. | 53/311 |
| 2,878,631 | 3/1959 | Bartlett | 53/317 |
| 3,005,300 | 10/1961 | Shields | 53/367 X |
| 3,879,921 | 4/1975 | Leonard | 53/367 X |
| 4,098,053 | 7/1978 | Shank | 53/367 X |
| 4,658,565 | 4/1987 | Westbrook et al. | 53/317 X |

FOREIGN PATENT DOCUMENTS

| | | | |
|---|---|---|---|
| 243901 | 4/1963 | Australia | 53/310 |
| 487578 | 12/1953 | Italy | 53/311 |

*Primary Examiner*—John Sipos
*Assistant Examiner*—Linda B. Johnson

[57] ABSTRACT

A device for orientating ball caps in a bottle type capping machine of the type having an upper cap chute assembly, a lower cap chute assembly, a capping stabilizer assembly and a conveyor carrying bottles to be capped. The device consists of a sleeve sized to fit vertically between the upper cap chute assembly and the lower cap chute assembly to allow each ball cap to travel therethrough. A mechanism is for securing the sleeve to the bottle type capping machine in its vertical position. Another mechanism is for rotating each ball cap one hundred and eighty degrees when traveling through the sleeve by the force of gravity so that each ball cap will be in its proper position to be placed upon and capped to each bottle traveling along the conveyor below the capping stabilizer assembly.

1 Claim, 1 Drawing Sheet

BALL CAP ORIENTER

BACKGROUND OF THE INVENTION

The instant invention relates generally to bottle capping machines and more specifically it relates to a device for orientating ball caps which provides a mechanism for placing the ball caps in a proper position for capping.

There are available various conventional bottle capping machines which do not provide the novel improvements of the invention herein disclosed.

SUMMARY OF THE INVENTION

A primary object of the present invention is to provide a device for orientating ball caps that will overcome the shortcomings of the prior art devices.

Another object is to provide a device for orientating ball caps so that the ball caps will always be in a proper position to be capped onto bottles.

An additional object is to provide a device for orientating ball caps that can be quickly mounted between an upper chute assembly and a lower chute assembly and a capping stabilizer assembly above a conveyor carrying the bottles therealong.

A further object is to provide a device for orientating ball caps that is simple and easy to use.

A still further object is to provide a device for orientating ball caps that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 3:
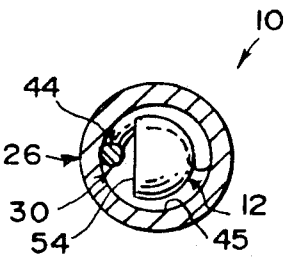
FIG. 3 is a cross sectional view taken along line 3—3 in FIG. 2.
Figure 4:
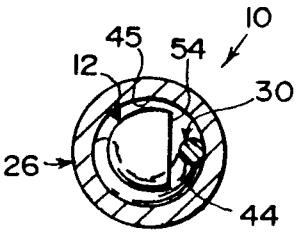
FIG. 4 is a cross sectional view taken along line 4—4 in FIG. 2.
Figure 2:
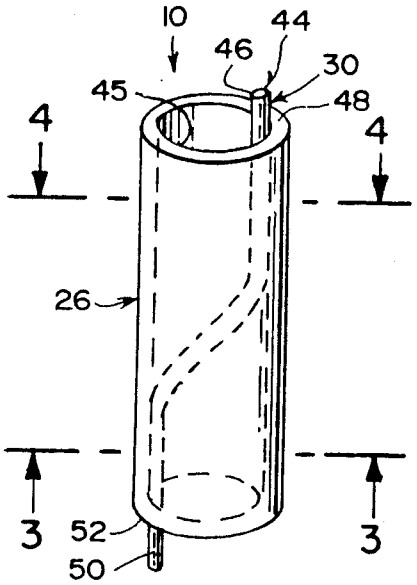
FIG. 2 is a perspective view of the instant invention.
Figure 1:
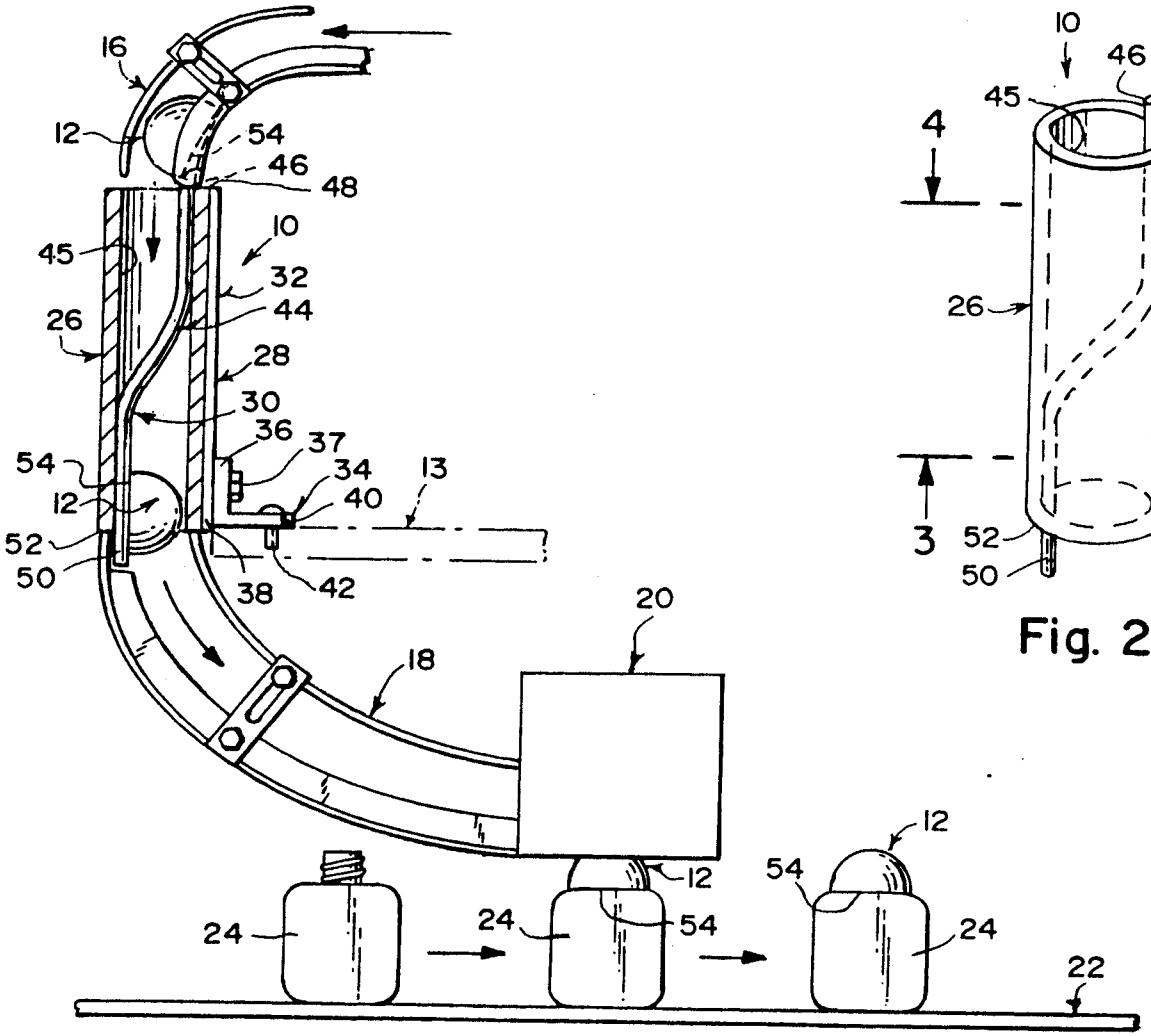
FIG. 1 is a vertical cross sectional view of the instant invention between the upper and lower cap chute assemblies.

Turning now descriptively to the drawings, in which similar reference characters denote similar elements throughout the several views, the Figures illustrate a device 10 for orientating ball caps 12 in a bottle type capping machine of the type having an upper cap chute assembly 16, a lower cap chute assembly 18, a capping stabilizer assembly 20 and a conveyor 22 carrying bottles 24 to be capped. The device 10 consists of a sleeve 26 sized to fit vertically between the upper cap chute assembly 16 and the lower cap chute assembly 18 to allow each ball cap 12 to travel therethrough. A mechanism 28 is for securing the sleeve 26 to the bottle type capping machine 13 in its vertical position. Another mechanism 30 is for rotating each ball cap 12 one hundred and eighty degrees when traveling through the sleeve 26 by the force of gravity so that each ball cap 12 will be in its proper position to be placed upon and capped to each bottle 24 traveling along the conveyor 22 below the capping stabilizer assembly 20.

The securing mechanism 28 includes a plate 32 affixed vertically to the sleeve 26, such as by welding or the like. An L-shaped bracket 34 has a vertical arm 36 affixed by a bolt 37 to the lower end 38 of the plate 32 and a horizontal arm 40 affixed by bolt 42 to the bottle filling and capping machine 12.

The rotating mechanism 30 includes an elongated rod 44 affixed to the interior 45 of the sleeve 26 in a one hundred and eighty degree twist by welding or the like, with the upper end 46 of the rod 44 extending from the top back edge 48 of the sleeve 26 in alignment with the upper cap chute assembly 16. The lower end 50 of the rod 44 extends from the bottom front edge 52 of the sleeve 26 in alignment with the lower cap chute assembly 18. The flat end 54 of each ball cap 12 can ride on the rod 44 when traveling through the sleeve 26.

The sleeve 26, the plate 32, the L-shaped bracket 34 and the elongated rod 44 are all fabricated out of a durable metal material, such as stainless steel or the like.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A device for orientating ball caps with a flat end in a bottle type capping machine of the type having an upper cap chute assembly and a lower cap chute assembly, in combination with a capping stabilizer assembly and a conveyor carrying bottles to be capped, said device comprising:

a) a hollow cylindrical sleeve having an interior surface and a vertical longitudinal axis, said sleeve sized to fit vertically between the upper cap chute assembly and the lower cap chute assembly to allow each ball cap to travel therethrough; and said sleeve having a top back edge and a bottom front edge;

b) means for securing said sleeve to the bottle type capping machine in its vertical position; and c) means for rotating each ball cap one hundred and eighty degrees when traveling through said sleeve by the force of gravity so that each ball cap will be in its proper position to be placed upon and capped to each bottle traveling along the conveyor below the capping stabilizer assembly, wherein said rotating means includes an elongated rod for contacting said flat end to guide each ball cap as each ball cap travels through said sleeve, said rod affixed to the interior surface of said sleeve in a one hundred and eighty degree twist with the upper end of said rod extending from the top back edge of said sleeve in alignment with the upper cap chute assembly and the lower end of said rod extending from the bottom front edge of said sleeve in alignment with the lower cap chute assembly.

* * * * *